United States Patent [19]

Gasser

[11] 4,106,739

[45] Aug. 15, 1978

[54] BUMPER EDGE MEMBER FOR CHAIRS

[76] Inventor: George E. Gasser, 6455 Sodom-Hutchings Rd., Girard, Ohio 44420

[21] Appl. No.: 798,646

[22] Filed: May 19, 1977

[51] Int. Cl.[2] ..... A47B 95/00

[52] U.S. Cl. ..... 248/345.1

[58] Field of Search ..... 5/100, 360; 248/345.1; 312/137, 140.4

[56] References Cited

U.S. PATENT DOCUMENTS

| | | | |
|---|---|---|---|
| 2,547,239 | 4/1951 | Walker | 312/140.4 UX |
| 2,564,386 | 8/1951 | Webb | 248/345.1 UX |
| 2,673,600 | 3/1954 | Cramer | 5/360 |

FOREIGN PATENT DOCUMENTS

| | | | |
|---|---|---|---|
| 224,765 | 12/1968 | U.S.S.R. | 5/360 |

*Primary Examiner*—James C. Mitchell

*Attorney, Agent, or Firm*—Webster B. Harpman

[57] ABSTRACT

A continuously hollow edge member is applied to the edges of the structural portions of a chair to protect and finish the same and provide visual indication of desirable locations for securing the welt and upholstery thereto.

6 Claims, 3 Drawing Figures

BUMPER EDGE MEMBER FOR CHAIRS

BACKGROUND OF THE INVENTION (1) Field of the Invention:

This invention relates to chair constructions and the like wherein structural members with perimeter edges are covered with upholstery and edge moldings to provide a finished effect.

(2) Description of the Prior Art:

U.S. Pat. No. 1,936,113 discloses a rubber bumper attached to a metal channel which in turn is affixed to the structure to be protected. U.S. Pat. Nos. 3,393,933 and 3,647,260 disclosed thickened resilient shapes defining a relatively closed channel which is distorted and applied to the edge of the construction to be protected. U.S. Pat. No. 3,836,043 discloses a solid shape flanged longitudinally and U.S. Pat. No. 4,003,180 shows a doubly flanged resilient shape. None of the disclosures of these prior art patents suggest the application of a continously extending hollow cushioned edge member that can be applied to the edge of a plywood structure defining a portion of the chair to provide a cushioned protective edge which is both attractive and practical.

SUMMARY OF THE INVENTION

A bumper edge member for chairs comprises a continuous hollow shape having spaced parallel flanges longitudinally thereof and formed of a resilient high density resin such as polyurethane. Continously extending offset surfaces on the outer sides of the flanges provide guide lines for the attachment of the bumper edge member to the edges of structural portions of chairs or the like and guide lines for the subsequent attachment of welts and upholstery thereover.

DESCRIPTION OF THE PREFERRED EMBODIMENT

Figure 1:
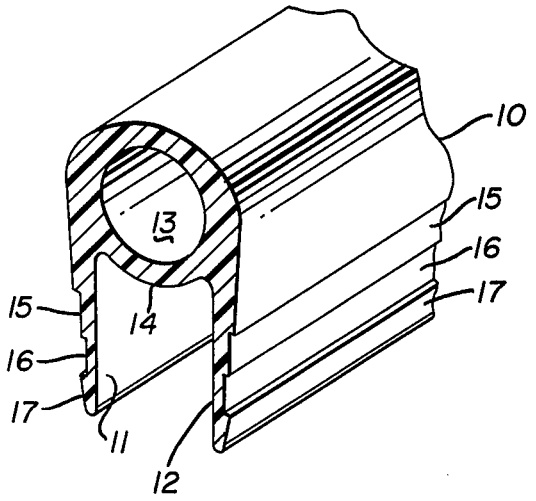
FIG. 1 is a perspective elevation (with parts broken away) of the bumper edge member embodying the present invention.

In the form of the invention chosen for illustration herein, the bumper edge member, as best seen in FIG. 1 of the drawings, comprises a continuous hollow member 10 having a pair of spaced parallel flanges 11 and 12 depending from the opposite sides thereof. The hollow member 10 has a cross sectionally round hollow center 13 with the portion of the member defining the hollow center 13 and extending between the flanges 11 and 12 arranged in a convex surface 14. The outer sides of the spaced parallel flanges 11 and 12 have continuously extending offset parallel surfaces 15, 16 and 17 respectively.

Still referring to FIG. 1 of the drawings, it will be seen that the surfaces 15 are offset slightly inwardly with respect to the upper portions of the flanges 11 and 12 and that the surfaces 16 are offset slightly inwardly with respect to the surfaces 15. The lowermost surfaces 17 are offset slightly outwardly with respect to the surfaces 16 and at a slight angle from vertical and/or the plane of the flanges 11 and 12.

Figure 2:
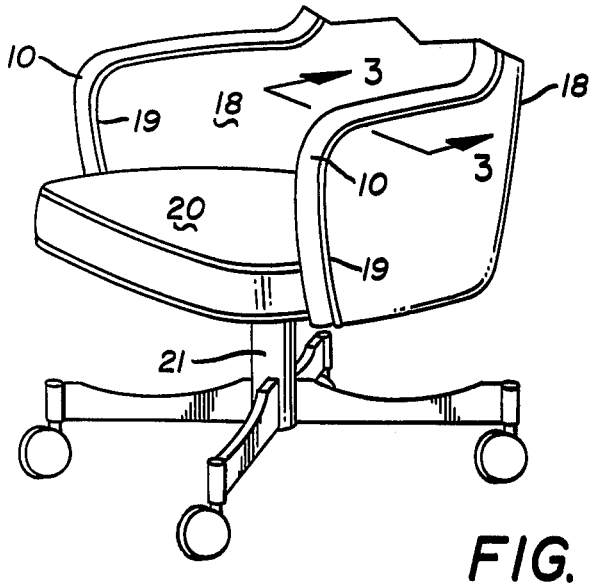
FIG. 2 is a perspective elevation (with parts broken away) of a chair incorporating the bumper edge member shown in FIG. 1.

By referring now to FIG. 2 of the drawings, a partial view of a chair incorporating the bumper edge member of the invention may be seen and those skilled in the art will observe that the chair illustrated has a structural member such as may be formed of shaped plywood which forms the back and arm portions generally indicated by the numeral 18. The structural plywood is covered on both sides by upholstry materials and the forward and upper edges of the plywood structure is finished with the bumper edge member of the present invention and indicated thereon by the numeral 10. It is separated on both sides from the upholstery material by welts 19. The chair includes a conventional seat portion 20 and a swivel base 21.

Figure 3:
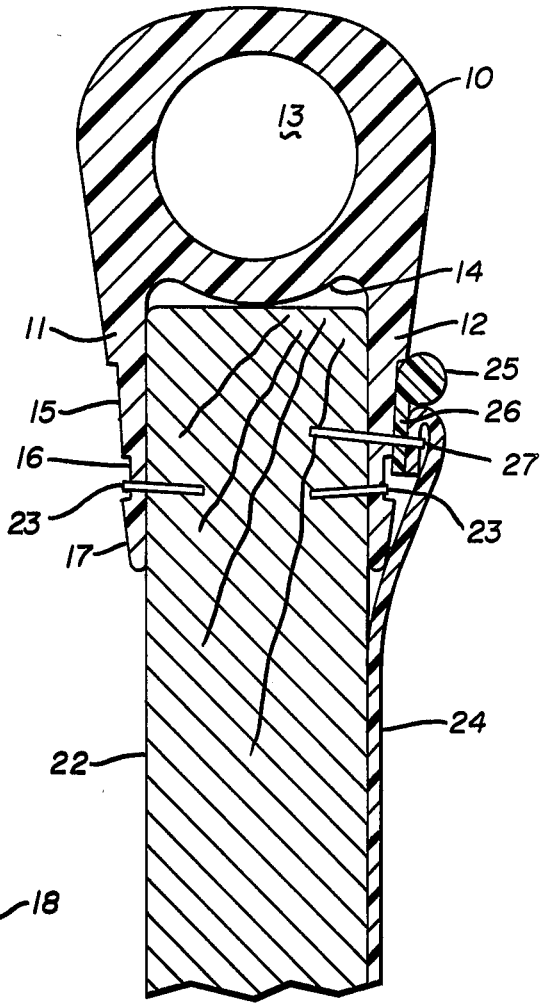
FIG. 3 is an enlarged cross sectional elevation on line 3—3 of FIG. 2.

By referring now to FIG. 3 of the drawings which is an enlarged cross sectional elevation on line 3—3 of FIG. 2, it will be seen that the plywood structural back and sides of the chair seen in FIG. 2 is illustrated and indicated by the numeral 22. The bumper edge member 10 is shown positioned on the perimeter edge of the plywood 22 and the spaced parallel depending flanges 11 and 12 are illustrated in their normal position against the outer surfaces of the plywood 22 and secured thereto by a plurality of staples 23 which are engaged in the innermost offset surfaces 16 of the flanges 11 and 12 respectively.

Still referring to FIG. 3 of the drawings, it will be seen that the upholstery material is illustrated on one side of the plywood 22 and indicated by the numeral 24. It extends upwardly and over the lower portions of the flange 12 as illustrated and those skilled in the art will understand that similar upholstery material with or without padding or other cusioning between it and the plywood 22 is provided on the opposite side thereof. The construction illustrated in FIG. 3 incorporates a welt 25 with its depending flange 26 positioned on the longitudinal surface 15 of the flange 12 and thereby located in parallel relation with the upper or outermost surface of the bumper edge member 10 which considerably improves the appearance of the chair incorporating the construction. The uppermost portion of the upholstery material 24 is positioned against the flange 26 of the welt 25 and staples 27 driven therethrough and into the plywood 22 at spaced intervals as will occur to those skilled in the art. The upholstery material is then turned downwardly over the staples 27 and the lower portion of the flange 22 of the bumper edge member so that it extends downwardly over the surface 17 thereof and as hereinbefore mentioned cushioning or padding material is frequently positioned between the upholstery material and the plywood structure 22 or the upholstery material is substantially thick and forms a desirable smooth transition.

Still referring to FIG. 3 of the drawings it will be seen that the resilient bumper edge member 10 is capable of protecting the edge of the chair equipped therewith so that it cannot be damaged by being pushed into objects such as tables or the like and there are two air spaces contributing to the cushion effect. The first of these is the cross sectionally circular hollow interior 13 of the bumper edge member 10 and the second is the space between the edge of the plywood 22 or other structural member and the convex outer surface 14 of the section of the bumper edge member which extends between the flanges 11 and 12.

The bumper edge member in addition to providing a protective edge to the perimeter surface of the chair so as to guard against upholstery damage, provides a soft and appealing decor to outline the chair and outline its contours. It additionally insures a soft contact with a table edge where the chair comes in contact with the same. When formed of the preferable material as specified hereinbefore, it provides a non-marking surface which will prevent damage to walls and decorative panels and it provides a pleasant yielding edge treatment for the chair with respect to handling by a person seated therein. In addition to the foregoing it will occur to those skilled in the art that the cushion bumper edge member adds considerably to the life of an otherwise vulnerable section of a commercial chair such as those used in a restaurant and the like and additionally it provides an opportunity to carry accent color through the hollow center section if desired as the material from which the bumper edge member is formed may be transparent, translucent or of any color desired.

Although but one embodiment of the present invention has been illustrated and described, it will be apparent to those skilled in the art that various changes and modifications may be made without departing from the spirit of the invention and having thus described my invention what I claim is.

I claim:

1. A bumper edge member for chairs and the like which have structural portions defining perimeter edges, the edge member comprising:

a continuous resilient member having an elongate body portion and a pair of spaced flanges extending outwardly from said body member, said flanges being located on said body member to receive therebetween a structural portion of a chair;

a first cushioning means defined in said body member, said first cushioning means including a hollow chamber defined in said body member to be located between said flanges in front of an edge of such structural portion;

a second cushioning means defined in said body member to be located between said flanges; and said second cushioning means being positioned in said body member to be located between a chair structural portion edge and said first cushioning means.

2. The bumper edge member set forth in claim 1 and wherein said hollow chamber is cross sectionally circular.

3. The bumper edge member for chairs set forth in claim 1 and wherein the edge member is formed of a resilient high density resin.

4. The bumper edge member for chairs set forth in claim 1 and wherein the spaced flanges are substantially parallel and are of an overall length substantially equal to the continuous resilient member.

5. The bumper edge member set forth in claim 1 wherein said second cushioning means includes a portion of said body member which is convex in shape relative to said body portion to provide a limited area of contact with respect to a structural portion engaged thereagainst.

6. The bumper edge of claim 1 further including means on said flanges defining guide slots for indicating desirable areas to fasten upholstery material and trim to said resilient member.

* * * * *

UNITED STATES PATENT AND TRADEMARK OFFICE

CERTIFICATE OF CORRECTION

PATENT NO. : B1 4,106,739

DATED : July 23, 1991

INVENTOR(S) : George E. Gasser

It is certified that error appears in the above-identified patent and that said Letters Patent is hereby corrected as shown below:

Column 1, after line 27, insert

--a continuous resilient member having an elongate body portion and a pair of spaced flanges extending outwardly from said body member, said flanges being located on said body member to receive therebetween a structural portion of a chair;

a first cushioning means defined in said body member, said first cushioning means including a hollow chamber defined in said body member to be located between said flanges in front of an edge of such structural portion;

a second cushioning means defined in said body member to be located between said flanges;

said second cushioning means being positioned in said body member to be located between a chair structural portion edge and said first cushioning means; and--

Signed and Sealed this

Thirteenth Day of April, 1993

*Attest:*

*Attesting Officer*

STEPHEN G. KUNIN

*Acting Commissioner of Patents and Trademarks*

REEXAMINATION CERTIFICATE (1512th)

United States Patent [19]

Gasser

[11] B1 4,106,739

[45] Certificate Issued Jul. 23, 1991

[54] BUMPER EDGE MEMBER FOR CHAIRS

[76] Inventor: George E. Gasser, 6455 Sodom-Hutchings Rd., Girard, Ohio 44420

Reexamination Request:
No. 90/002,170, Oct. 12, 1990

Reexamination Certificate for:

| | |
|---|---|
| Patent No.: | **4,106,739** |
| Issued: | **Aug. 15, 1978** |
| Appl. No.: | **798,646** |
| Filed: | **May 19, 1977** |

[51] Int. Cl.[5] ..... A47B 95/00
[52] U.S. Cl. ..... 248/345.1
[58] Field of Search ..... 248/345.1; 5/100, 508; 52/288

[56] References Cited

U.S. PATENT DOCUMENTS

| | | | |
|---|---|---|---|
| 2,121,826 | 6/1938 | Roberts | 49/498 |
| 3,831,990 | 8/1974 | Singh et al. | 293/1 |
| 4,012,878 | 3/1977 | Ellingson | 52/288 |

FOREIGN PATENT DOCUMENTS

| | | | |
|---|---|---|---|
| 2450250 | 5/1976 | Fed. Rep. of Germany . | |
| 224765 | 12/1968 | U.S.S.R. | 5/360 |

*Primary Examiner*—Ramon O. Ramirez

[57] ABSTRACT

A continuously hollow edge member is applied to the edges of the structural portions of a chair to protect and finish the same and provide visual indication of desirable locations for securing the welt and upholstery thereto.

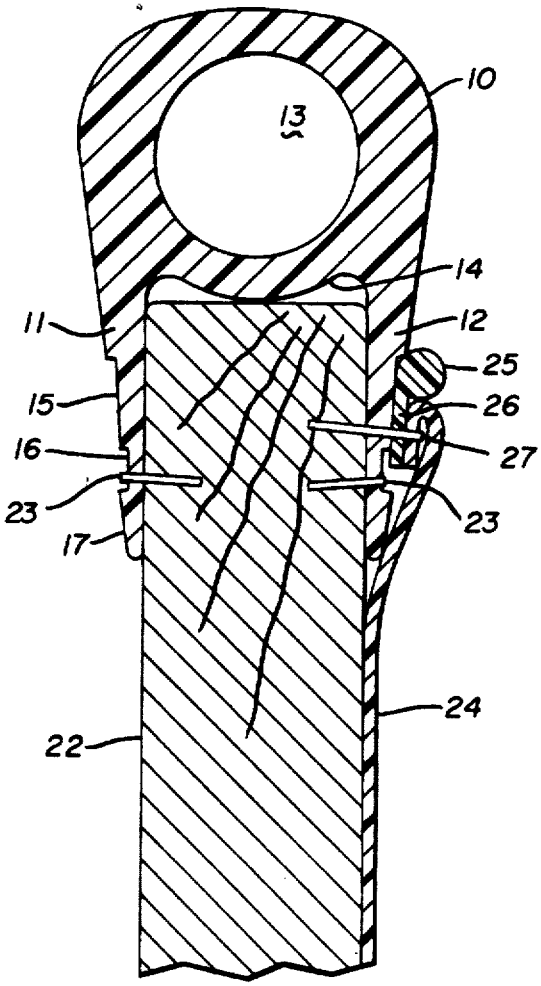

REEXAMINATION CERTIFICATE ISSUED UNDER 35 U.S.C. 307

THE PATENT IS HEREBY ANENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-5 is confirmed.

Claim 6 is determined to be patentable as amended.

New claims 7-13 are added and determined to be patentable.

6. [The bumper edge of claim 1 further including] *A bumper edge for chairs and the like which have structural portions defining perimeter edges, the edge member comprising:* means on said flanges defining guide slots for indicating desirable areas to fasten upholstery material and trim to said resilient member.

*7. The bumper edge member for chairs set forth in claim 3 wherein the resilient high density resin is polyurethane.*

*8. The bumper edge member for chairs set forth in claim 3 wherein said second cushioning means includes a portion of said body member which is convex in shape relative to said body portion to provide a limited area of contact with respect to a structural portion engaged thereagainst.*

*9. The bumper edge member set forth in claims 3 or 5 wherein the spaced flanges are substantially parallel and are of an overall length substantially equal to the continuous resilient member.*

*10. The bumper edge member set forth in claims 3 or 5 further including, means on said flanges defining guide slots for indicating desirable areas to fasten upholstery material and trim to said resilient member.*

*11. A bumper edge member for chairs and the like which have structural portions defining perimeter edges, the edge member comprising:*

*a continuous resilient member having an elongate body portion and a pair of spaced flanges extending outwardly from said body member, said flanges being located on said body member to receive therebetween a structural portion of a chair;*

*a first cushioning means defined in said body member, said first cushioning means including a hollow chamber defined in said body member to be located between said flanges in front of an edge of such structural portion;*

*a second cushioning means defined in said body member to be located between said flanges;*

*said second cushioning means being positioned in said body member to be located between a chair structural portion edge and said first cushioning means,*

*said edge member is formed of a resilient high density resin;*

*said spaced flanges are substantially parallel and are of an overall length substantially equal to the continuous resilient member, and*

*said second cushioning means includes, a portion of said body member which is convex in shape relative to said body portion to provide a limited area of contact with respect to the structural portion engaged thereagainst.*

*12. The bumper edge member as set forth in claim 11 further including, means on said flanges defining guide slots for indicating desirable areas to fasten upholstery material and trim to said resilient member.*

*13. The bumper edge member set forth in claim 11 wherein the resilient high density resin is polyurethane.*

* * * * *